United States Patent [19]

Dickakian

[11] 4,448,670

[45] May 15, 1984

[54] AROMATIC PITCH PRODUCTION FROM COAL DERIVED DISTILLATE

[75] Inventor: Ghazi Dickakian, Greenville, S.C.

[73] Assignee: Exxon Research and Engineering Co., Florham Park, N.J.

[21] Appl. No.: 399,472

[22] Filed: Jul. 19, 1982

Related U.S. Application Data

[63] Continuation-in-part of Ser. No. 346,625, Feb. 8, 1982.

[51] Int. Cl.[3] ..... C10C 1/00; C10C 1/20; C10C 3/00

[52] U.S. Cl. ..... 208/22; 208/44; 208/40; 423/447.4; 423/447.6; 423/448; 423/449

[58] Field of Search ..... 423/447.1, 447.2, 447.4, 423/447.6, 448, 449; 208/22, 40, 44

[56] References Cited

U.S. PATENT DOCUMENTS

| | | | |
|---|---|---|---|
| 2,066,386 | 1/1937 | Bergeim | 208/41 |
| 3,928,169 | 12/1975 | Conroy | 208/22 |
| 4,184,942 | 1/1980 | Angier et al. | 208/44 |
| 4,208,267 | 6/1980 | Diefendorf et al. | 208/22 |
| 4,219,404 | 8/1980 | Dickakian | 208/22 |
| 4,271,006 | 6/1981 | Dickakian | 208/45 |
| 4,363,715 | 12/1982 | Dickakian | 208/44 |

*Primary Examiner*—Delbert E. Gantz
*Assistant Examiner*—Helane E. Maull

[57] ABSTRACT

A process and a product of the process for preparing a pitch suitable for carbon artifact manufacture features a pitch having a weight content of between 80 and 100 percent toluene insolubles. The pitch is derived from a substantially deasphaltenated middle fraction of a feedstock, such as a coal distillate. The middle fraction is rich in 3, 4, 5 and 6 polycondensed aromatic rings. The pitch is characterized as being relatively free of impurities and ash.

16 Claims, 1 Drawing Figure

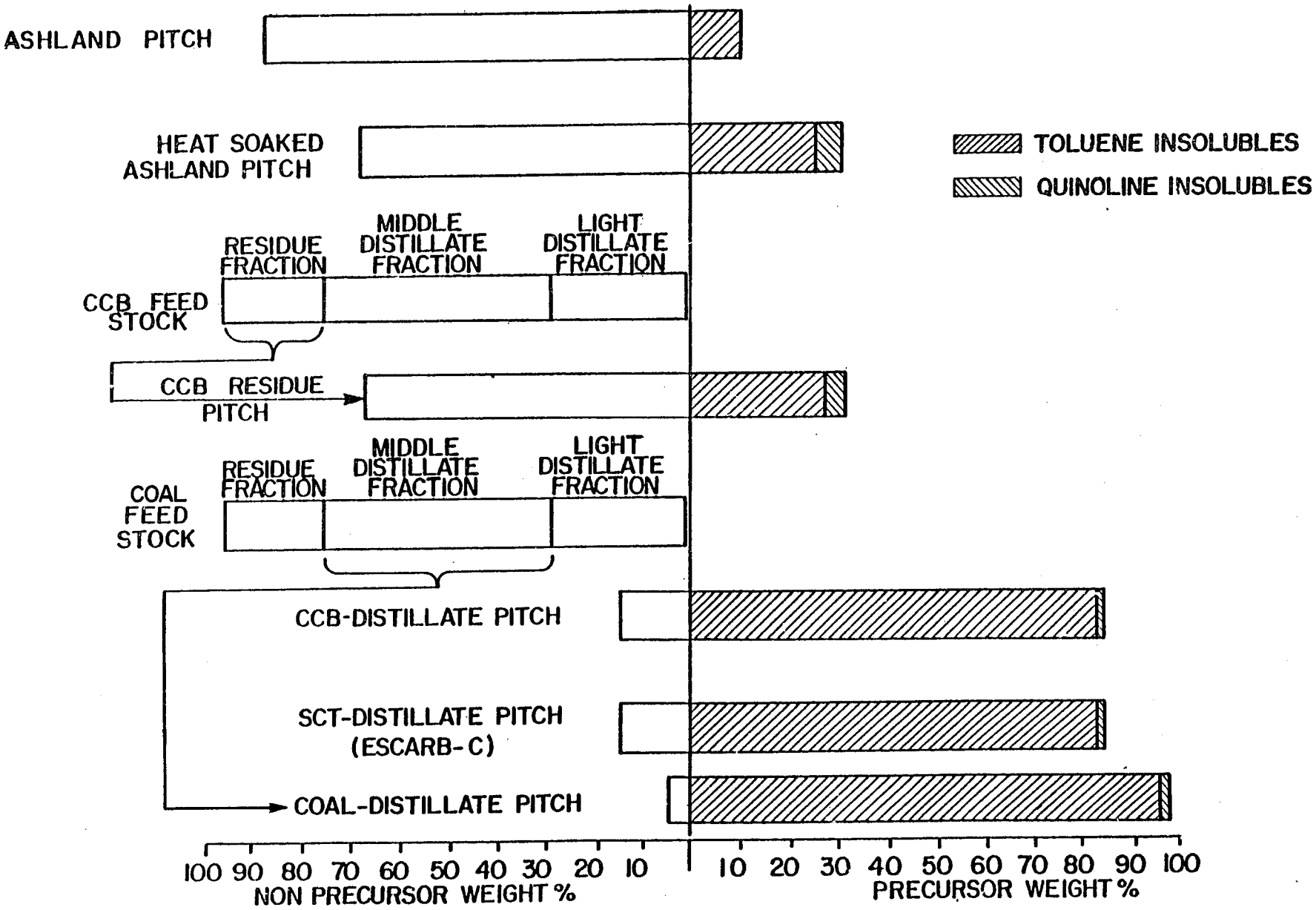
TOLUENE INSOLUBLES
QUINOLINE INSOLUBLES
ASHLAND PITCH
HEAT SOAKED ASHLAND PITCH
CCB FEED STOCK
RESIDUE FRACTION
MIDDLE DISTILLATE FRACTION
LIGHT DISTILLATE FRACTION
CCB RESIDUE PITCH
COAL FEED STOCK
RESIDUE FRACTION
MIDDLE DISTILLATE FRACTION
LIGHT DISTILLATE FRACTION
CCB-DISTILLATE PITCH
SCT-DISTILLATE PITCH (ESCARB-C)
COAL-DISTILLATE PITCH
NON PRECURSOR WEIGHT %
100 90 80 70 60 50 40 30 20 10
PRECURSOR WEIGHT %
10 20 30 40 50 60 70 80 90 100

AROMATIC PITCH PRODUCTION FROM COAL DERIVED DISTILLATE

RELATED APPLICATION

This application is a continuation-in-part of application U.S. Ser. No. 346,625 filed Feb. 8, 1982.

FIELD OF THE INVENTION

This invention relates to a highly aromatic pitch suitable for carbon artifact manufacturing, such as carbon fibers, and more particularly to a pitch that is produced by thermally heat-soaking a distillate oil obtained from coal processing and then vacuum stripping the unreacted oil fraction.

BACKGROUND OF THE INVENTION

Coal tar and coal oil distillates are produced as by-products or as primary products, when processing coal. Coal can be converted into metallurgical coke, coal briquettes (solid fuel), chemicals, gas and synthetic liquid fuels.

The characteristics and chemical composition of coal oils produced during coal processing will vary depending on the type of coal, the type of process and the process conditions. The aromaticity, the chemical structure and the aromatic ring distribution of coal oils or distillates are important characteristics, which depend upon the process temperature.

One example of coal processing at high temperature is the production of metallurgical coke from coking coal. In this process, good coking coal is cokified at around 1200° C. in the absence of air to produce metallurgical coke. Coal tar is produced as an overhead by-product of this process. Coal tars are distilled using vacuum or steam distillation to produce coal distillate. These coal distillates derived from high temperature coal processes have very high aromaticity (85–95% of aromatic carbon atoms [as determined by carbon nuclear magnetic resonance spectroscopy]).

There are a number of low temperature coal processes such as: non-coking coal carbonization into solid fuel briquettes, coal gasification and coal hydroliquification.

In all these low temperature processes, the resultant coal tars and oils have a low aromaticity (40–55% of aromatic carbon atoms). One process of particular interest is the Lurgi coal gasification. In the Lurgi process, coal is gasified in the presence of air and steam to produce gas, coal oil and a coal tar. This process was developed during World War II and a modified process is used commercially in South Africa today.

The coal oil or coal tar distillates produced by a high coking process or a low temperature coal gasification process consist of a complex mixture of alkyl substituted polycondensed aromatics of varying aromaticity and degree of aromatic ring condensation.

Highly advanced analytical methods magnetic resonance spectroscopy, such as carbon and proton nuclear are used to characterize these coal oil and coal tar distillates. Mass spectrometry is used to obtain quantitative data on chemical and molecular structure, aromatic ring distribution, compound type, carbon number distribution and molecular weight.

It is one object of this invention to produce highly aromatic pitch from a coal oil or coal tar distillate.

Coal oil or coal tar distillates should contain very low ash or solid impurities. Ash or solid impurities are detrimental to carbon fiber performance.

Coal oil and coal tar distillates should have low molecular weight compounds and contain little of the high molecular weight asphaltenes (n-heptane insolubles) which have a high coking characteristic. Coke is detrimental for processing the pitch into a carbon artifact.

Coal oil and coal tar distillates should contain the desired polycondensed aromatic structures which can undergo a polymerization/condensation reaction leading to the formation of liquid crystals in high content in the pitch.

SUMMARY OF THE INVENTION

The present invention pertains to a high Ti pitch for producing carbon artifacts such as fibers. An aromatic pitch with a very high liquid crystal fraction (80–100%) can be prepared by thermally reacting a substantially deasphaltenated fraction of a coal distillate which is rich in 3, 4, 5 and 6 aromatic rings, at approximately 420°–440° C. for 15–90 minutes and then vacuum stripping the unreacted mixture to remove at least a portion of the unreacted oils at a temperature greater than 400° C. at approximately 1.0 mmHg of pressure.

More specifically, the coal distillate fraction is heat soaked at approximately 430° C. and vacuum stripped at an approximate temperature of 420° C.

For the purposes of definition the terms "substantially deasphaltenated feedstock" and/or "substantially deasphaltenated middle fraction of a feedstock" shall mean: a deasphaltenated material obtained from a middle cut of a feedstock, and/or one caused to be relatively free of asphaltenes by means of obtaining a distillate portion of said feedstock which when further treated will form a precursor which can be spun into a carbon fiber and which has the following general characteristics:

(1) a relatively low coking value;

(2) a relatively low content of ash and impurities; and (3) a relatively narrow average molecular weight range.

A typical weight percentage of asphaltenes in a substantially deasphaltenated coal distillate being in a range of approximately 5.0 to 10.0%.

It is an object of this invention to provide an improved pitch for manufacturing a carbon artifact.

It is another object of the invention to provide a pitch for manufacturing carbon fibers which is more uniform, and which is free of ash and impurities.

It is a further object of this invention to provide a pitch having high toluene insolubles, and which does not necessarily require Ti solvent extraction prior to spinning into fibers.

These and other objects of this invention will be better understood and will become more apparent with reference to the following detailed description considered in conjunction with the accompanying drawings.

BRIEF DESCRIPTION OF THE DRAWINGS

A FIGURE shows a graphical representation of various feedstocks including the deasphaltenated coal distillate fraction of this invention, and corresponding Ti content materials derived from heat soaking these feedstocks.

DETAILED DESCRIPTION OF THE INVENTION

Generally speaking, the pitch of this invention is one which has a high crystal fraction as measured by the content of toluene insolubles, and which is further characterized as relatively free of impurities and ash as defined by a low quinoline insolubles content. The pitch of this invention is derived from a coal oil or coal tar fraction which is rich in 3, 4, 5 and 6 polycondensed aromatic rings.

Table 1, below, illustrates the characteristics of two coal distillates: (1) a coal oil obtained from coal gasification as an example of coal oils produced from a low temperature coal process; and (2) a coal tar distillate from the distillation of coal tar which is produced during coal coking operations, illustrating an example of a coal distillate from a high temperature process:

TABLE 1

Physical Characteristics of Coal Distillates from High and Low Temperature Coal Processing

| | Coal Oil from Coal Gasification Process | Coal Tar Distillate from Coal Coking Process |
|---|---|---|
| Specific Gravity @ 15° C. | 1.0071 | 1 0890 |
| Ash Content, wt % | <0.0001 | <0.0001 |
| Viscosity (cps) @ 210° F. | 2.92 | 4.10 |
| Flash Point (coc), °C. | 80 | 120 |
| n-Heptane Insolubles (asphaltene), wt % | 5.0 | 3.0 |
| Coking Value (2 hrs @ 550° C.) | 4.1 | 3.3 |
| Average Mol Wt | 201 | 192 |
| BMCI | 97 | 139 |

[BMCI = Bureau of Mines Correlation Index]

The aromaticity and the chemical structure of coal distillates vary from one type to another. The aromaticity of the coal oil is very much dependent on the coal processing temperature. Table 2, below, gives the aromaticity (aromatic carbon atoms as determined by $C_{13}$ NMR) and the chemical structure as defined by average proton distribution (by proton NMR) of the coal distillates respectively obtained by high and low temperature processing of coal:

TABLE 2

Aromaticity and Chemical Structure of Coal Distillates from High and Low Temperature Processing of Coal

| | Coal Oil from Coal Gasification Process | Coal Tar Distillate from Coal Coking Process |
|---|---|---|
| Aromaticity (%) (aromatic carbon atom) | 44–57 | 85–95 |
| Aromatic Protons (%) | 47 | 90 |
| Benzyllic Protons (%) | 36 | 34 |
| Paraffinic Protons (%) | 41 | 11 |
| Carbon Number in Side Chain | 3.2 | 1.3 |
| Naphthenic Carbon (%) of Total Paraffinic | 57 | 100 |

Coal contains carbon, hydrogen, oxygen, nitrogen and sulfur in comparison to petroleum-derived products, which contain hydrocarbon and sulfur. Coal distillates, contain carbon, hydrogen, nitrogen, sulfur and a relatively high content of oxygen. The elemental analysis of coal oil and coal tar distillates obtained from low and high temperature coal processes, are respectively given in Table 3, below:

TABLE 3

Elemental Analysis of Coal Distillates

| | Coal Oil from Coal Gasification Process | Coal Tar Distillate from Coal Coking Process |
|---|---|---|
| Carbon (wt %) | 82.92 | 91.72 |
| Hydrogen (wt %) | 9.18 | 6.05 |
| Nitrogen (wt %) | 1.04 | 0.83 |
| Oxygen (wt %) | 5.91 | 1.05 |
| Sulfur (wt %) | 0.84 | 0.50 |
| Sodium (ppm) | 3.3 | 10.0 |
| Potassium (ppm) | 1.8 | 1.0 |
| C/H Atomic Ratio | 0.75 | 1.26 |

Like other heavy aromatic residues from pyrolysis or cracking of a petroleum product, coal oils and coal tar distillates derived from low or high temperature coal processing contain a large quantity of polycondensed aromatics of a narrow aromatic ring distribution (mainly polycondensed aromatics with 3, 4, 5, and 6 rings. Table 4, below, gives the aromatic ring distribution and aromatic ring composition of coal oils and coal tar distillates.

TABLE 4

Aromatic Ring Distribution of Coal Distillates from Low and High Temperature Coal Processes

| Aromatic Ring Distribution | Coal Oil from Coal Gasification Process | Coal Tar Distillate from Coal Coking Process |
|---|---|---|
| 1 | 26.0 | 13.0 |
| 2 | 45.7 | 36.8 |
| 3 | 14.6 | 22.6 |
| 4 | 10.3 | 21.8 |
| 5 | 2.3 | 4.5 |
| 6 | 0.7 | 1.0 |
| Hydrocarbon Aromatics | 77.9 | 74.0 |
| Oxygen Containing Aromatics | 13.8 | 16.6 |
| Sulfur Containing Aromatics | 8.2 | 9.3 |

Coal oils and coal tar distillates have a wide range of boiling point characteristics depending on the type of process and the corresponding process conditions. The boiling point characteristics of the coal distillate feed determine the part of the coal distillate which will remain during heat soaking in a reactor. This fraction will react to form pitch. The higher the boiling point of the oil or distillate, the higher will be the yield of the pitch. The distillation characteristics (ASTM D1160 method) of coal tar distillate from a coal coking process, and coal oil distillate from a coal gasification process, each rich in 3, 4, 5 and 6 polycondensed aromatic rings and which is useful in this invention, are given in Table 5, below:

TABLE 5

Distillation Characteristics of Coal Tar and Oil Distillates (ASTM D-1160)

| Volume % | Coal Oil from Coal Gasification Process (°C.) | Coal Tar Distillate from Coal Coking Process (°C.) |
|---|---|---|
| IBP | 71 | 213 |
| 1% | — | 235 |
| 5% | 137 | 253 |
| 10% | 160 | 276 |
| 20% | 188 | 303 |
| 30% | 218 | 316 |
| 40% | 243 | 328 |
| 50% | 271 | 335 |
| 60% | 304 | 350 |
| 70% | 343 | 358 |
| 80% | 398 | 377 |

TABLE 5-continued

| Distillation Characteristics of Coal Tar and Oil Distillates (ASTM D-1160) | | |
|---|---|---|
| Volume % | Coal Oil from Coal Gasification Process (°C.) | Coal Tar Distillate from Coal Coking Process (°C.) |
| 90% | 509 | 437 |

One can determine the molecular structure of coal distillates using advanced analytical methods such as a high resolution mass spectrometer (MS350) with computerized data acquisition and handling. Table 6, below, gives the compound type, and typical molecular structure of the oil from coal gasification, and distillate from a coal coking operation:

TABLE 6

| Molecular Structure of Coal Oil and Distillate | | | |
|---|---|---|---|
| Compound Type | Molecular Structure | Coal Oil from Coal Gasification Process (wt %) | Coal Tar Distillate from Coal Coking Process (wt %) |
| $C_nH_{2n-8}$ | Indanes | 6.0 | 1.7 |
| $C_nH_{2n-10}$ | Indenes | 9.5 | 2.0 |
| $C_nH_{2n-12}$ | Naphthalenes | 17.9 | 15.3 |
| $C_nH_{2n-14}$ | Naphthenonaphthalene | 7.5 | 6.2 |
| $C_nH_{2n-16}$ | Acenaphthalenes | 10.3 | 5.1 |
| $C_nH_{2n-18}$ | Phenanthrenes | 9.5 | 14.9 |
| $C_nH_{2n-20}$ | Naphthenophenanthrenes | 3.4 | 5.0 |
| $C_nH_{2n-22}$ | Pyrenes | 4.9 | 11.5 |
| $C_nH_{2n-24}$ | Chrysenes | 2.3 | 5.4 |
| $C_nH_{2n-26}$ | Cholanthrenes | 0.6 | 1.0 |
| $C_nH_{2n-10}S$ | Benzothiophenes | 2.3 | 1.4 |
| $C_nH_{2n-12}S$ | Naphthenobenzothiophenes | 1.3 | — |
| $C_nH_{2n-14}S$ | Indenothiophenes | 0.6 | 0.5 |
| $C_nH_{2n-16}S$ | Naphthothiophenes | 2.2 | 3.1 |
| $C_nH_{2n-18}S$ | Naphthenonaphthothiophenes | — | 1.0 |
| $C_nH_{2n-10}O$ | Benzofuraans | 2.7 | 0.9 |
| $C_nH_{2n-12}O$ | Naphthenobenzofurans | 0.8 | 1.0 |
| $C_nH_{2n-14}O$ | Indenobenzofurans | 0.6 | 0.3 |
| $C_nH_{2n-16}O$ | Naphthenofurans | 4.9 | 3.6 |
| $C_nH_{2n-18}O$ | Naphthenonaphthofurans | 0.8 | 0.6 |
| $C_nH_{2n-20}O$ | Acenaphthyenofurans | 0.5 | 0.5 |
| $C_nH_{2n-22}O$ | Phenauthrenofurans | 1.6 | 1.9 |

To produce a pitch in accordance with the present invention, a coal oil or coal tar distillate feedstock rich in 3, 4, 5 and 6 polycondensed aromatic rings as illustrated in Table 5, is heat soaked at temperatures in the range of about 350° C. to 500° C. Optionally and preferably, the heat soaking is conducted at temperatures in the range of about 380° C. to about 460° C. and most preferably at temperatures in the range of about 410° C. to 440° C. In general, heat soaking is conducted for times ranging from one minute to about 200 minutes, and preferably from about 15 to 90 minutes. It is particularly preferred that heat soaking be done in an atmosphere of nitrogen, or alternatively in a hydrogen atmosphere. Optionally, however, heat soaking may be conducted at high pressure or reduced pressures; for example, pressures in the range of from about 50 to 100 mm of mercury.

When the heat soaking stage is completed, the reaction mixture is then subjected to a reduced pressure at a liquid temperature between 360°–420° C. (preferably at 400°–420° C.) to remove at least a portion of the unreacted oil. Preferably, all of the unreacted oils are removed to concentrate and increase the liquid fraction in the final pitch product. The use of a high liquid temperature; e.g., 400°–420° C., is very desirable. This helps to remove the distillable unreacted oils, which if left in the final pitch product, tend to reduce the liquid crystal content. Optionally, the pitch can be purged with nitrogen to accelerate the removal of oil from the pitch.

The resultant pitch product has a low melting point (190°–250° C.), has a very high aromaticity (85% of atomic carbon atoms by carbon NMR method) and contains a high liquid crystal fraction. The pitch composition is defined readily by using solvent analysis. The content of insolubles in toluene at room temperature, and the content of insolubles in quinoline at 75° C. defines the pitch. The toluene insoluble (Ti) fraction in the pitch can be used to give a measure of the liquid crystal content in the pitch. The objective of the invention is to obtain an aromatic pitch containing 80–100% (by weight) of toluene insolubles, and preferably 90–100% of toluene insolubles, with a quinoline insoluble content of less than 10% (by weight).

Also, if desired, the toluene insolubles in the pitch can be separated by extraction with toluene at room or elevated temperature.

A more complete understanding of the process of this invention can be obtained by reference to the following examples which are illustrative only and are not meant to limit the scope of the invention which is defined in the hereinafter appended claims.

EXAMPLE 1–5

In each of the following examples, coal oil obtained from a coal gasification process was used. The physical, chemical structure, molecular structure, elemental analysis, aromatic ring distribution and distillation characteristics have been described hereinbefore.

The following experimental method was used:

About 600 grams of a coal oil feed was charged into an electrically heated reactor equipped with nitrogen injection and mechanical agitation. The feed was heated to a desired temperature of 420°–440° C. under a blanket of nitrogen, and allowed to react at that temperature for a desired time of 15 to 90 minutes with good agitation under nitrogen.

The heat soaked mixture was then vacuum stripped at reduced pressure (0.2–1.0 mmHg) at a liquid temperature of 400°–420° C. to remove all distillable oils. The vacuum stripped pitch was allowed to cool under reduced pressure and discharged. Results of Examples 1–5 are illustrated in Table 7, hereinafter.

The percent quinoline insolubles in the product pitch was determined by a standard technique of quinoline extraction at 75° C. (ASTM Test Method No. D2318/76).

The toluene insolubles in the pitch were determined by the following standard Extraction Procedure (SEP):

About 40 grams of crushed vacuum stripped pitch were mixed for 18 hours at room temperature with 320 ml of toluene. The mixture was thereafter filtered using a 10–15 micron fritted glass filter.

The filter cake was washed with 80 ml of toluene, reslurried and mixed for four hours at room temperature with 120 ml of toluene. This was filtered using a 10–15 micron glass filter.

The filter cake was also washed with 80 ml of toluene followed by a wash with 80 ml of heptane, and finally the solid was dried at 120° C. in a vacuum for 24 hours.

The toluene insolubles in the pitch was also determined by a one stage etraction method. The pitch and toluene (pitch: toluene ratio 1:8) was agitated at room temperature for 4 hours and then filtered, washed and dried.

The optional anisotropicity of the pitch was determined by first heating the pitch to 375° C., and then cooling. A sample of the pitch was placed on a slide with Permount, a histological mounting medium sold by the Fisher Scientific Company, Fairlawn, N. J. A slip cover was placed over the slide by rotating the cover under hand pressure. The mounted sample was crushed to a powder and evenly dispersed on the slide. Thereafter, the crushed sample was viewed under polarized light at a magnification factor of 200X in order to estimate the percent optical anisotropicity.

Table 7, below, gives results for Examples 1–5.

TABLE 7

THE PRODUCTION OF COAL DISTILLATE PITCH

| | Heat Soaking Stage | | | Vacuum Stripping Stage | | Pitch Composition (%) | | |
|---|---|---|---|---|---|---|---|---|
| | | | | Liquid | | | | Toluene Insolubles |
| Examples | Temperature (°C.) | Time (min) | Pressure (mm Hg) | Temperature (°C.) | Oil ( ) Removed | Toluene Insolubles (SEP) | Quinoline Insolubles ( ) | One Stage ( s) |
| 1 | 420 | 75 | 1.0 | 365 | 5.3 | 92.6 | 8.9 | 100 |
| 2 | 430 | 90 | 1.0 | 365 | 4.6 | 93.5 | 3.8 | 100 |
| 3 | 430 | 90 | 0.25 | 400 | 4.8 | 97.2 | 7.5 | 100 |
| 4 | 430 | 90 | 0.25 | 410 | 3.7 | 95.2 | 6.7 | 100 |
| 5 | 440 | 15 | 0.25 | 420 | | 97.5 | 1.7 | 100 |

| | Toluene Insoluble Characteristics | | | | Pitch Chemical Composition | | | | |
|---|---|---|---|---|---|---|---|---|---|
| Examples | Tg | C/H | Viscosity cps @ 360° C. | Optical Anistrophy ( ) | Carbon (wt. %) | Hydrogen (wt. %) | Oxygen (wt. %) | Sulfur (wt. %) | Nitrogen (wt. %) |
| 1 | 189 | 1.47 | 1,654 | 75–100 | — | — | — | — | — |
| 2 | 177 | — | 440 | — | 88.82 | 5.62 | 3.4 | 0.53 | 1.58 |
| 3 | 210 | 1.61 | — | — | 87.14 | 5.27 | 3.3 | 0.6 | 1.72 |
| 4 | 212 | 1.56 | 1,349 | — | 89.88 | 5.16 | 2.9 | 0.57 | 1.58 |

Referring to the illustrative Figure, various feedstocks are shown including the substantially deasphaltenated coal distillate of this invention. These feedstocks are shown divided into their corresponding percentages of useable (precursor) pitch materials, and non-useable (non-precursor) pitch materials. It is observed that when all the cat cracker bottom fractions are used to obtain precursor materials, only a small percentage of liquid crystal rich materials are obtained. For example, heat soaked Ashland Pitch is observed to contain only approximately 25 percent Ti precursor.

Such a pitch material must be further treated to extract the useable Ti fraction. However, the problem with extracting the Ti content from such a pitch material is that it is very difficult to do this without also including the so-called "bad actors". In other words, the impurities and ash are also carried along. In addition, heat treating these low Ti materials will very often produce coke, which is detrimental to the spinning process.

Therefore, the elimination of the "bad actors" and the coke producing substances in advance of further processing would not only be desirable in producing a trouble-free precursor material, but also should usually eliminate the need to perform an additional extraction step.

Thus, it is observed that a coal distillate feedstock material which uses only a middle fraction, i.e. distillate fractions rich in 3, 4, 5 and 6 polycondensed aromatic rings will be virtually free of the "bad actors", and will contain between 80 and 100% Ti after heat soaking and vacuum stripping. Such precursor materials will be very uniform, relatively free of ash and impurities as further defined by a low quinoline insoluble content (less than 15% by weight), and will easily lend themselves to further controlled processing.

As aforementioned, such precursors may not require an additional extraction step for the Ti.

The FIGURE also represents similar results obtained from other feedstock materials such as Steam Cracker Tars (SCT) and Cat Cracker Bottoms (CCB). When the middle fractions of these feedstocks are separated, heat soaked, and vacuum stripped, it is observed that high content Ti substances are also produced.

Thus, the invention is not necessarily limited to the starting materials, but rather to the realization of the need to prefractionate and separate the middle fractions from these materials, and to vacuum strip these fractions after heat soaking at temperatures generally in excess of 400° C.

A pitch of this invention can be generally defined by the following solvent analysis:

| Solvent Analysis | |
|---|---|
| Toluene insolubles wt % (SEP method) | 80–100 |
| Quinoline insolubles wt % (ASTM D2318-66) | 1.0–15 (preferably less than 5%) |
| Aromaticity (% Aromatic carbon atom) | 80–90 |
| Melting point (°C.) | 150–250 |
| Glass Transition Temperature (°C.) (Tg) | 170–220 |
| Ash wt % | nil–0.1 |
| Optical Activity (% by polarized light microscopy) | 70–100 |
| Asphaltene (%) by weight | 5–10 |

Having thus described this invention, what is desired to be protected by Letters Patent is presented in the following appended claims.

What is claimed is:

1. A pitch suitable for carbon artifact manufacture, comprising by weight content between 80 and 100 percent toluene insolubles, said pitch having been derived, by heat soaking followed by vacuum stripping, from a substantially deasphaltenated middle fraction of a coal distillate feedstock rich in 3, 4, 5 and 6 polycondensed aromatic rings, and wherein said pitch is further characterized as being relatively free of impurities and ash.

2. A pitch suitable for carbon artifact manufacture, comprising by weight content between 80 and 100 percent toluene insolubles, said pitch having been derived, by heat soaking followed by vacuum stripping, from a substantially deasphaltenated middle fraction of a coal distillate feedstock rich in 3, 4, 5 and 6 polycondensed aromatic rings, and wherein said pitch is further characterized as being relatively free of impurities and ash, as further defined by a weight content of approximately less than 15 percent quinoline insolubles.

3. A pitch suitable for carbon artifact manufacture, such as the manufacture of carbon fibers, comprising by weight content between 80 and 100 percent toluene insolubles, and derived, by heat soaking followed by vaccum stripping, from a substantially deasphaltenated middle fraction of a coal distillate rich in 3, 4, 5, and 6 polycondensed rings, said pitch being further characterized as being relatively free of impurities and ash.

4. A pitch suitable for carbon artifact manufacture, such as the manufacture of carbon fibers, comprising by weight content between 80 and 100 percent toluene insolubles, and derived, by heat soaking followed by vacuum stripping, from a substantially deasphaltenated middle fraction of a coal distillate rich in 3, 4, 5 and 6 polycondensed rings, said pitch being further characterized as being relatively free of impurities and ash, as further defined by a weight content of approximately less than 15 percent quinoline insolubles.

5. A process for preparing a pitch suitable for carbon artifact manufacture, comprising the steps of:

(a) obtaining a substantially deasphaltenated middle fraction of a coal distillate feedstock which is rich in 3, 4, 5 and 6 polycondensed aromatic rings;
(b) subjecting said middle fraction to heat soaking to produce a pitch intermediate; and
(c) removing a portion of said pitch intermediate to produce a pitch comprising between 80 and 100 percent by weight of toluene insolubles, and which is further characterized as being relatively free of impurities and ash.

6. The process of claim 5, wherein said thermal reaction includes heat soaking said middle fraction at a temperature in an approximate range of between 350° and 500° C. for a duration of from 15 to 90 minutes 760 mm of mercury.

7. The process of claim 6, wherein said middle fraction is heat soaked at approximately 430° C. for 15 to 90 minutes at 760 mm of mercury.

8. The process of claim 5, wherein said portion of said pitch intermediate comprises oils, and further wherein said oils are removed by vacuum stripping said intermediate at a temperature in an approximate range of between 400° to 420° C. at approximately 1 mm of mercury.

9. A process for preparing a pitch suitable for carbon artifact manufacture, comprising the steps of:

(a) distilling a coal distillate to obtain a substantially deasphaltenated middle fraction rich in 3, 4, 5 and 6 polycondensed aromatic rings;
(b) heat soaking said middle fraction; and
(c) vacuum stripping said heat soaked middle fraction to remove oils therefrom, resulting in a pitch comprising 80 to 100 percent by weight of toluene insoulbles and further characterized as being relatively free of impurities and ash.

10. The process of claim 9, wherein said heat soaking step (b) includes heat soaking said middle fraction at a temperature in an approximate range of between 350° and 500° C. for a duration of from 15 to 90 minutes at 760 mm of mercury.

11. The process of claim 10, wherein said middle fraction is heat soaked at approximately 430° C. for 15 to 90 minutes at 760 mm of mercury.

12. The process of claim 9, wherein said vacuum stripping step (c) includes vacuum stripping said heat soaked middle fraction at a temperature in an approximate range of between 400° and 420° C. at approximately 1 mm of mercury.

13. A process for preparing a pitch suitable for carbon artifact manufacture, comprising the steps of:

(a) distilling a coal distillate to obtain a substantially deasphaltenated middle fraction rich in 3, 4, 5 and 6 polycondensed aromatic rings;
(b) heat soaking said middle fraction; and
(c) vacuum stripping said heat soaked middle fraction to remove oil therefrom, resulting in a pitch comprising 80 to 100 percent by weight of toluene insolubles and further characterized as being relatively free of impurities and ash.

14. A pitch suitable for carbon artifact manufacture made by the process including the steps of:

(a) distilling a coal distillate to obtain a substantially deasphaltenated middle fraction rich in 3, 4, 5 and 6 polycondensed aromatic rings;
(b) heat soaking said middle fraction; and
(c) vacuum stripping said heat soaked middle fraction to remove oils therefrom, resulting in a pitch comprising 80 to 100 percent by weight of toluene insolubles and further characterized as being relatively free of impurities and ash.

15. A process for preparing a pitch suitable for carbon artifact manufacture, comprising the steps of:

(a) distilling a coal distillate to obtain a substantially deasphaltenated middle fraction rich in 3, 4, 5 and 6 polycondensed aromatic rings;
(b) heat soaking said middle fraction; and
(c) vacuum stripping said heat soaked middle fraction to remove oils therefrom, resulting in a pitch comprising 80 to 100 percent by weight of toluene insolubles and further characterized as being relatively free of impurities and ash, as further defined by a weight content of approximately less then 15 percent quinoline insolubles.

16. A pitch suitable for carbon artifact manufacture made by the process including the steps of:

(a) distilling a coal distillate to obtain a substantially deasphaltenated middle fraction rich in 3, 4, 5 and 6 polycondensed aromatic rings;
(b) heat soaking said middle fraction; and
(c) vacuum stripping said heat soaked middle fraction to remove oils therefrom, resulting in a pitch comprising 80 to 100 percent by weight of toluene insolubles and further characterized as being relatively free of impurities and ash, as further defined by a weight content of approximately less than 15 percent quinoline insolubles.

* * * * *